US008419231B2

(12) United States Patent
Anderson

(10) Patent No.: US 8,419,231 B2
(45) Date of Patent: Apr. 16, 2013

(54) LED EXTENDED OPTIC TIR LIGHT COVER WITH LIGHT BEAM CONTROL

(76) Inventor: Leroy E. Anderson, Boise, ID (US)

( * ) Notice: Subject to any disclaimer, the term of this patent is extended or adjusted under 35 U.S.C. 154(b) by 35 days.

(21) Appl. No.: 13/180,234

(22) Filed: Jul. 11, 2011

(65) Prior Publication Data

US 2012/0044699 A1 Feb. 23, 2012

Related U.S. Application Data

(60) Provisional application No. 61/362,883, filed on Jul. 9, 2010.

(51) Int. Cl.
*F21V 5/00* (2006.01)

(52) U.S. Cl.
USPC ..... 362/311.06; 362/311.02; 362/309; 362/326

(58) Field of Classification Search ..... 362/311.02, 362/244, 309, 326, 311.06, 311.01
See application file for complete search history.

(56) References Cited

U.S. PATENT DOCUMENTS

| | | | | |
|---|---|---|---|---|
| 4,530,042 | A | 7/1985 | Cibie | |
| 4,607,318 | A | 8/1986 | Lindae | |
| 4,669,032 | A | 5/1987 | Lietar | |
| 6,837,605 | B2 | 1/2005 | Reill | |
| 7,121,679 | B2 | 10/2006 | Fujimoto | |
| 7,207,697 | B2 | 4/2007 | Shoji | |
| 2006/0039160 | A1 | 2/2006 | Cassarly | |
| 2006/0158887 | A1 | 7/2006 | Holder | |
| 2009/0310356 | A1 * | 12/2009 | Laporte | 362/239 |
| 2010/0053973 | A1 * | 3/2010 | Shastry et al. | 362/296.05 |
| 2010/0226143 | A1 * | 9/2010 | Cheung et al. | 362/516 |

* cited by examiner

*Primary Examiner* — Laura Tso
(74) *Attorney, Agent, or Firm* — Robert L. Shaver; Dykas & Shaver

(57) ABSTRACT

An optic for producing an asymmetrical beam of light for restricting light output to an area below a midplane of the optic, and for directing light to the sides or down from the midplane.

13 Claims, 5 Drawing Sheets

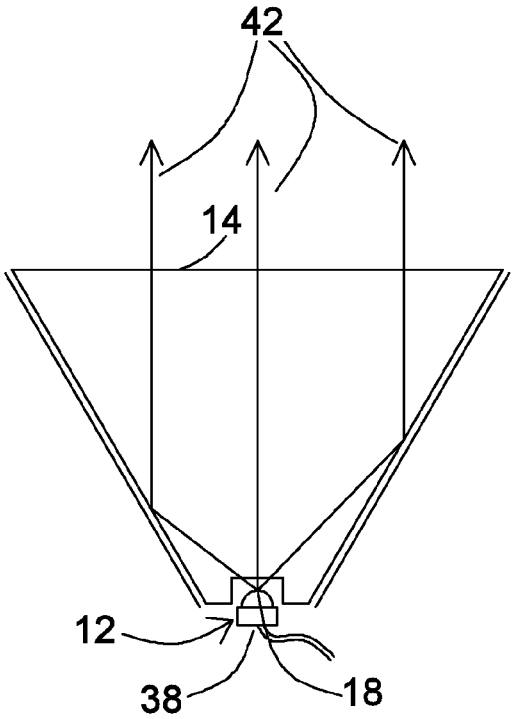
FIG.1- PRIOR ART
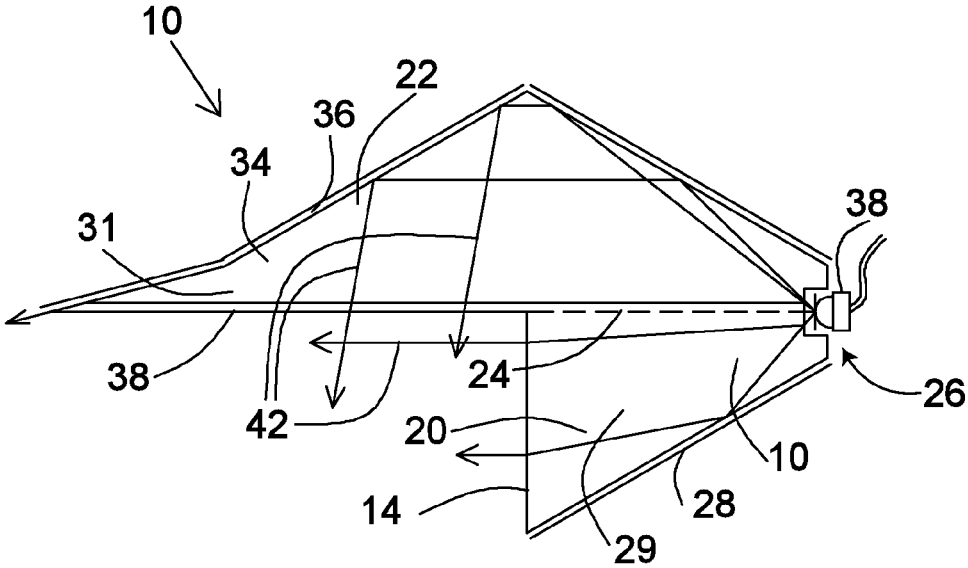
FIG.2

LED EXTENDED OPTIC TIR LIGHT COVER WITH LIGHT BEAM CONTROL

PRIORITY/CROSS-REFERENCE TO RELATED APPLICATIONS

This application claims the benefit of U.S. Provisional Application No. 61/362,883, filed Jul. 9, 2010, the disclosure of which is incorporated by reference.

TECHNICAL FIELD

The presently disclosed and claimed inventive concept(s) generally relates to light-emitting diodes (LED) optics, and more particularly to an optic with selected geometries for dispersing light to selected regions other than straight ahead.

BACKGROUND

The lighting industry is transitioning towards LEDs from incandescent and compact fluorescent lights. In home and business lighting alone 1.9 billion 60-watt incandescent bulbs will need to be replaced in the U.S. once the Energy Independence and Security Act takes effect in 2012. This figure does not take into account the number of 75- and 100-watt bulbs that will also need to be replaced. Additionally, many other countries have passed laws outlawing incandescents.

While LEDs are superior to compact fluorescent lamps (CFLs) in energy-efficiency and longevity, the only real thing holding LEDs back is that, unlike CFLs, they can only emit light straight outward. This limitation leads to two main inconveniences and safety hazards: 1. Blinding from oncoming lights and 2. A limited angle of visibility.

The currently disclosed technology is for an innovative new optic technology that can avoid these hazards by precisely tuning the direction in which light beams are emitted from LED bulbs. LEDs fitted with this optic will help with safety, lighting precision and energy efficiency.

Currently technology of lights, including incandescents, halogens, CFLs and LEDs are lacking in certain features. For instance headlamps and vehicle headlights and fog lights direct light to undesired places such as upward, which can blind oncoming people. Challenges also exist in flashlights, emergency lights, bicycle lights, and office and business lighting that can only direct light in a very limited angle of visibility.

The primary problem with current LED light bulbs is their inefficient use of light rays. This is particularly troublesome in current home and business lighting. These bulbs emit all of their light beams straight downward in one strong beam that concentrates all the light in a very restricted area. This leads to situations where the light in a room illuminates the center of a room and leaves the corners dark.

Directional limitations in light bulbs leads to several other problems:

- Vehicle headlight glare that unnecessarily blinds oncoming traffic at night. Headlight glare also affects pedestrians, cyclists and anyone else who might be on the road.
- Mining or emergency room head lamps that blind others when the user looks up.
- Emergency stairway lighting that fails to direct the majority of its light down onto stairs where it is needed most.
- Vehicle fog lights that can decrease driver visibility in rainy or snowy conditions by shining straight ahead and limiting the effectiveness of the fog light.

People are particularly eager for a fix to headlight and fog light glare into oncoming driver's eyes. Complaints about headlight glare and its potential link to accidents abound. In 2001 the U.S. National Highway Traffic Safety Administration opened a public docket requesting comments regarding headlight glare. By 2008 they had received over 5,000 complaints. Due to these complaints and other research, headlight glare is now at the forefront of their research about potential causes of nighttime crashes.

Flashlights are another product hindered by limited light beam control. Like other light bulbs, flashlights are restricted to emitting light in only one direction straight ahead. This limits flashlight users' visibility to approximately 90 of the 180 degrees in front of them. This limitation is particularly detrimental in the case of police and military flashlights. Current one-directional flashlights force service personnel to sweep their flashlights side-to-side when entering a dark room where suspects may be hiding, thus placing them in a potentially harmful situation when they remove light from one area. This same phenomenon of limited angle of visibility also affects night bicycle riders because their bicycle lights only illuminate a small area in front of them.

This host of problems is caused by limitations in current lighting technology that only permits light to be emitted in one direction. At this time, there is no way to direct light beams from an LED bulb in multiple directions, such as straight downward, straight upward, to the sides, or around in 360 degrees.

Intense heat generation is the biggest disadvantage of LEDs. This heat reduces efficiency, and shortens the life span of the bulb. First generation heat reduction systems are being used in current LEDs, but the technology has a long way to go before LEDs reach their maximum efficacy. Thus, LED thermal management is in need of some real innovation. The disclosed technology includes an improved heat dissipation system. The disclosed technology will eliminate the overheating issues common with LEDs and make them more practical for use with Light Beam Control Optics (LBCO). The heat dissipation system will also prolong the life of LED bulbs.

SUMMARY

The disclosed technology is a type of optic for use with an LED light or other light source, with the capability of spreading a light beam in desired directions. Prior art optics direct a beam of light mostly forward, with a small amount of spread to the sides in a generally conical pattern, A Light Beam Control Optic (LBCO) of the disclosed technology can subdivide the cone of light into halves, quarters, and even eighths to direct any amount of the light beam in any desired direction out of the typical cone. LBCOs block light from heading needlessly in directions where the user does not need it while intensifying light where it is needed most.

Current LED light beams may use a plastic conical optic that only permits exiting light beams to be directed straight ahead. However, a LBCO of the disclosed technology can be configured to emit light in many directions. For instance, a LBCO can be used to redirect all of the light from vehicle headlights downward and to the sides where the driver needs light, rather than in an upward direction that blinds oncoming traffic or that wastes light into the sky. This light redirection will also make the beam emitted downward brighter and extend for a longer distance by redirecting the light that is blocked from going upward. For purposes of this discussion, the disclosed technology will be termed LBCO.

LBCOs work with any lighting source, but they are ideal for the directed light emitted from LEDs. LBCOs are made from solid polymethylmethacrylate (PMMA) plastic or any other appropriate polymer. They can be engineered in numerous shapes that will each direct light in a unique pattern. LBCOs will allow 100 percent of the light from a light source to exit the optic in a chosen direction or series of directions.

LBCOs use an extended lens length on top (the upper half of a horizontally oriented light) of the standard conical optic lens with a flat face, to redirect light beams. The extended lens has multiple curved polygons with varying angles. These extended pieces of plastic provide another surface for light beams to contact before they are emitted from a device (headlight, headlamp, etc.), and basically redirect light so that no light exits the optic in a chosen direction, such as above the midplane, which is often to block the light going into the sky or oncoming drivers eyes. The angle of the extended lens of the optic acts as a reflector base and can be adjusted to account for refraction and produce any desired angle of light.

Specifically, the curving slopes of the polygons are engineered so that light hits the optic at an angle greater than 42 degrees in areas that result in light exiting in desired directions, and at an angle less than 42 degrees in areas that are not preferred angles for light to exit the optic. Light beams hit the wall of the optic and reflect back down into the material of the optic. This extra surface contact redirects the light beams.

It is important to note that the entire extended lens length is surrounded by an air space. It is integral to the technology that the optic is surrounded by a material such as air space that has a sufficiently different density from PMMA plastic. This difference in density will cause 100% of the light striking the interface between the plastic and the air to bounce off of the plastic surface and be redirected back into the plastic. This principle is termed Total Internal Reflectance (TIR).

One version of the optic of the disclosed technology is made up of three sections-a flat portion (the flat surface which forms the end of a conical section); a curving forward/upper/extended portion; and, if desired, additional divisions of the curving slope portion to create extra angles. The flat portion is basically a part of the optic through which light from the LED light source can pass straight forward with no obstruction or redirection. The curving slope portion is positioned at a downward (or upward) angle so that it will create a reflector surface to reflect the light from the LED downward (or upward, or sideways). Lastly, additional divisions can be added to the curving slope portion to create extra angled reflector surfaces to reflect light from the LED in multiple directions.

For instance, an LBCO could be engineered to cut the light beam emitted from a vehicle headlight in half to eliminate blinding issues to oncoming traffic.

Thus, none of the light would be wasted by exiting above the midplane like it does in current LEDs. Instead, by using a LBCO, the curving angle of the sloping rear portion of the LBCO will make light above the midplane hit the wall of the LBCO at an angle less than 42 degrees. This angle will stop the top half of the light beams from escaping and cause the light to bounce back down into the material of the optic and then be reflected straight ahead below the midline of the optic. However, light directed into the sloping portion of the LBCO below the midplane will hit the flat end of the optic at an angle greater than 42 degrees. This angle will allow light beams to pass through the optic and emit light straight ahead below the midplane. With this angle manipulation, an LBCO can redirect the top half of the light beam cone which currently goes upward into the sky and into the eyes of oncoming traffic back downward to illuminate the road below the midplane.

There are numerous uses of LEDs with LBCOs that span many international markets. LBCOs work on 110 and 220 volts and AC or DC current. They can also be engineered to fit on any type of bulb. Some of the specific uses of LBCOs are standard-use room light bulbs for home or business lighting, vehicle headlights and fog lights, flashlights, bicycle lights, headlamps and stairway emergency lights.

Standard LED light bulbs can use LBCOs to create a softer, more evenly distributed light. Current light bulbs use a beam of light emitted straight outward that only illuminates the center part of a room and excludes the far corners. This limitation causes inconvenience and possible safety risks. An LBCO can be engineered to reflect light rays in 360 degrees, thus enabling light to reach the far corners of a room. LBCOs can also create up to a 39 degree angle of downward illumination. Since the light beam would be less concentrated, it can create a softer light that is ideal for dining rooms, living rooms, and bathrooms. Conversely, a LBCO could be engineered to direct light in a particular direction to create a stronger light for offices and craft or task rooms. It is important to note that when using a headlight fitted with an LBCO, drivers will not have a reduction in lighting. In fact, the light provided will be brighter and extend longer because it will not be lost skyward through diffusion. Fog lights can also benefit from using LED lights with LBCOs. LBCOs in vehicle fog lights will allow drivers to see better in inclement weather by rotating light in a conical shape and redirecting it away from the precipitation. This redirected light beam will stop light from being reflected by the moisture particles back to inhibit what the driver sees.

20 million flashlights are sold each year in Canada alone. Flashlights, particularly police and military flashlights, can benefit from using LED lights with LBCOs to increase the angle of visibility provided by the light. Instead of emitting light straight outward and limiting flashlight users' visibility to approximately 90 of the 120 degrees in front of them, LBCOs can redirect the light beam to provide a full 180 degree field of vision. The optic will cut the conical shaped light beam in sections and redirect beams that are on an upward trajectory downward towards the ground and out to both the left and the right. This will reduce the amount of times one must sweep a flashlight left and right to see a larger area.

Bicycle lights can also benefit from the phenomenon of increased angle of visibility that is a boon to flashlights. Night bicycle riders could benefit from having a larger area illuminated in front of them. This could be achieved by having a LBCO redirect the light that is on an upward trajectory downward towards the road and out to the sides. Also, since bicycle light beams would be directed downward, they would not blind oncoming people or vehicular traffic.

Headlamps can be used in myriad applications making their potential sales immense. Headlamps used by emergency room personnel, miners, cavers, scuba divers, etc. can benefit from using LED lights with LBCOs to redirect the beam where it is most effective. In particular, emergency room headlamps could use LBCOs to direct light only straight downward onto patients so when medical professionals look up they do not temporarily blind their colleagues.

Emergency lights are used in schools, office buildings, apartment buildings, churches and public buildings worldwide making their potential sales huge. Emergency stairway lighting can benefit from using LBCOs to more effectively project light downward onto stairs where it is needed in an emergency situation. Many current stairway emergency lights waste their light by directing at least half of it upward toward the ceiling. An LBCO would allow all the light emitted from emergency lights to go straight downward onto the stairs. An added benefit of using LBCOs with stairway emergency lights is that, since they use energy-efficient LEDs, the battery life would last 4 to 6 hours rather than the average 1.5 hours for incandescent bulbs.

There are three principal advantages of LBCOs: safety, lighting precision and energy efficiency. LBCOs enhance safety by directing light beams away from where a user does not need it (e.g., the sky, and oncoming traffic), and redirecting it where a user does need it. LBCOs are the most precise lighting system available because they can be engineered to direct light in any exact direction or series of directions desired. Since the light is being reflected to the exact location desired, none of it is "wasted" by going elsewhere. In turn, this makes the light brighter where light it is needed most. Lastly, LBCOs are energy efficient because they use an LED light bulb that requires less energy and lasts longer than a CFL. Therefore, LBCOs can be marketed as an innovative new product that is green, safe and economical.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept (s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

BRIEF DESCRIPTION OF THE DRAWINGS

FIG. 1 is a cross section of a prior art optic with an LED light source.

FIG. 2 is a cross section of an extended optic of the disclosed technology.

DETAILED DESCRIPTION OF THE EXEMPLARY EMBODIMENTS

Figure 3:
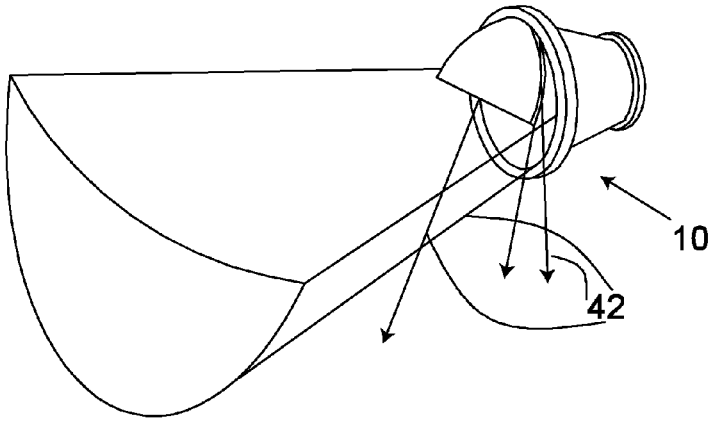
FIG. 3 is a perspective view of the light pattern of an extended optic of the disclosed technology.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is/are to cover all modifications, alternative constructions, and equivalents falling within the spirit and scope of the inventive concept(s) as defined in the claims.

LEDs have become increasingly more powerful in recent years, and promise to be able to provide very bright lights, bright enough to illuminate the road ahead of vehicles, such as cars, motorcycles and bicycles. A desirable type of LED light is one which utilizes an optical phenomenon called "total internal reflection," in which the light is reflected from the inner surfaces of a plastic optic. This can include an asymmetric optic which forms the light from an LED into an asymmetric beam which fits the requirements of a particular installation. One such asymmetric shape is one in which all or most of the light from the light source is directed below the midplane of the light source, so that light does not shine into the eyes of oncoming traffic, and so that light does not go into the sky to be reflected by fog or snow or rain, and which maximizes the utilization of the light on the road ahead of the vehicle. If desired, the asymmetrical light spread of such a light could also be directed to the sides in the near surface of the road ahead, to provide illumination for objects near the vehicle.

The invention is an optic for producing a controlled beam of light. Where a vehicle with headlights using the disclosed technology is used as an example, it is to be understood that this technology can be used in other vehicles, such as motorcycles, bicycles, or other vehicles. The light producing assembly can also be used in flashlights, and room lights or any light producing situation. The light producing assembly includes an LED light source and an LED light cover. The LED light cover is a small button-like plastic cover that fits over an LED light source and protects it from dust. The headlamp assembly includes a TIR optic of solid transparent material mounted adjacent to the LED light source. The TIR optic could replace the LED light cover, if desired. TIR stands for Total Internal Reflectance and refers to the phenomenon in which light is reflected from the inside surface of an optic if it strikes the surface of a material at an angle which is less than the critical angle, with each material having a different critical angle. If light traveling inside the optic strikes the outer edge of the optic at an angle greater than the critical angle, then the light exits the plastic and travels on in the air outside the plastic. As it leaves the plastic, it may be bent by refraction and have its trajectory slightly bent upon entering the air. If light from inside the optic strikes the outside of the optic at an angle less than the critical angle, which for polymethylmethacylate (PMMA) is 42.08 degrees, then 100% of the light is reflected back into the interior of the optic. The angle at which the light strikes the boundary layer between the optic material and the surrounding air is called the angle of incidence. If the light is reflected from the surface of the optic, it is reflected from the surface at an angle that is equal and opposite of the angle of incidence. The angle at which it leaves the point of reflection is called the angle of recedence. Thus, the angle of the recedence is equal and opposite to the angle of incidence.

When light crosses a boundary between materials with different refractive indices, the light beam will be partially refracted at the boundary surface, and partially reflected. However, if the angle of incidence is greater than the critical angle, the angle of incidence at which the light is refracted such that it travels along the boundary—then the light will stop crossing the boundary altogether, and instead, will be totally reflected back internally. This can only occur where light travels from a medium with a higher refractive index to one with a lower refractive index. For example, it will occur when passing from glass to air, but not when passing from air to glass. An extended optic TIR reflective surface can be built by extending the optic material out various distances and various angles from the base, and then providing an air space of about a minimum of 0.003 of an inch, and then backed by some material.

The TIR optic of the invention includes a generally cylindrical LED pocket in an apex of the cone portion of the TIR, which fits around the LED light cover and the LED light source.

FIG. 1 shows a prior art optic fitted over an LED 18. It is conical, with a cylindrical LED pocket 12, and a flat end 14. FIG. 2 shows an embodiment of the disclosed technology, with the TIR optic 10 of the disclosed technology being a solid, seamless piece of PMMA, but for purpose of description, it will be described as having a lower half 20 and an upper half 22, and a rear portion 29 and a forward portion 31. The plane between the lower half 20 and upper half 22 would typically be horizontal in the orientation in which it is used, and forms through the midplane 24 of the optic. Other material could be used, and each has its own specific angle at which light is reflected internally. There is no seam between the upper half 22 and the lower half 20. In one embodiment, the lower half of the TIR optic is a half cone, and includes one half of the LED pocket at the apex 26. The lower half 20 includes a circumvolving lower sidewall 28, and ends at a flat face 14, a distance from the apex of the half cone. The portion of the optic forming the upper and lower half can be 50:50, or 60:40, or other proportions as desired for a particular application.

The upper half of the TIR optic 10 of this embodiment has a rear, or first, portion which is the mirror image of the lower half 20 of the TIR optic. It has an apex 26, in which is located half of the cylindrical LED pocket 12. It also has a circumvolving upper sidewall and is seamlessly contiguous with the lower half 20 as far as the face of the lower half. The upper and lower halves join seamlessly at a midplane 24 of the TIR optic. The figures show exemplary light paths as 42.

Figure 7:
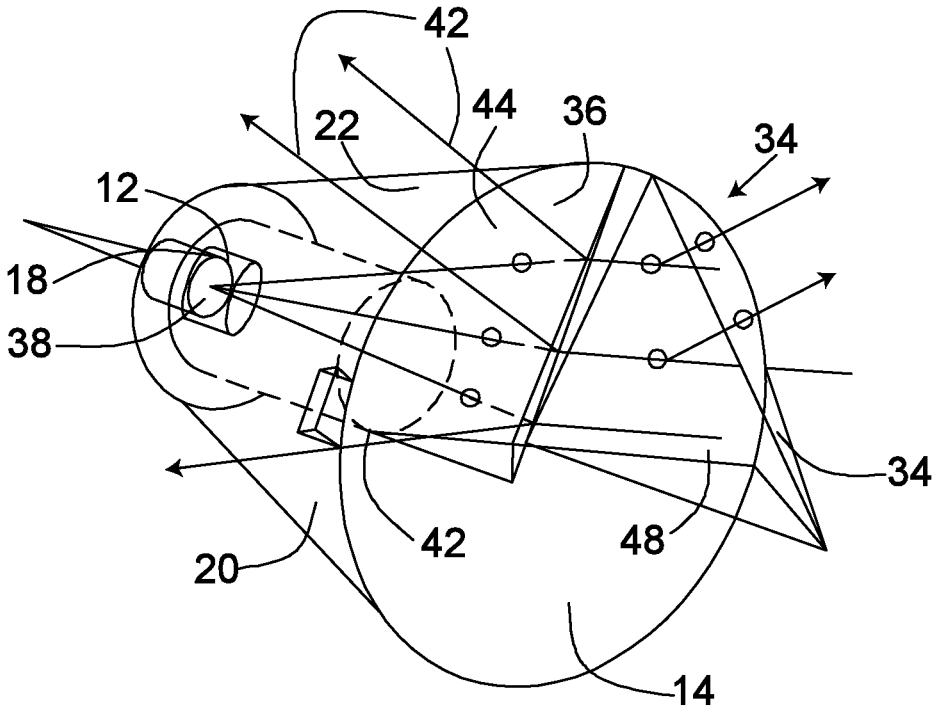
FIG. 7 is a perspective view of a version of an extended optic of the disclosed technology.

Rather than ending at a flat face as the lower half 20 does, the upper half 22 of this embodiment has a second, or forward, portion 34 that extends beyond the flat face 14 of the lower half. If viewed in cross section, the forward portion of the upper half is roughly one quarter of an oval and has a curved upper sidewall 36 and a flat underside 38. It can also be generally triangular in cross section, as shown in some of the figures, such as FIGS. 2, 3, and 4, or curved as shown in FIG. 7. The shape of this version of the optic is designed so that light which is directed from the LED light source 38 into the upper half 22 of the TIR optic, hits the upper wall 36 of the TIR optic at less than 42 degrees, and therefore bounces back down into the material of the optic. Thus, none of the light above the midplane 24 of the LED optic 10 exits in a trajectory above the midplane 24. All of the light created by the LED light source thus exits the LED optic below the midplane 24, traveling either straight forward or slightly down, as shown in FIG. 2. This causes all of the light exiting the TIR optic to be utilized for illuminating the road ahead, with none of the light going up towards the sky, where it can illuminate low lying fog, or rain and snow. This also eliminates light going into the eyes of oncoming traffic, or light being reflected by fog or snow going into the eyes of the driver, thus making it possible for the driver to see better in fog, snow, or rain. FIG. 3 shows the light distribution of the optic shown in FIG. 2.

Figure 5:
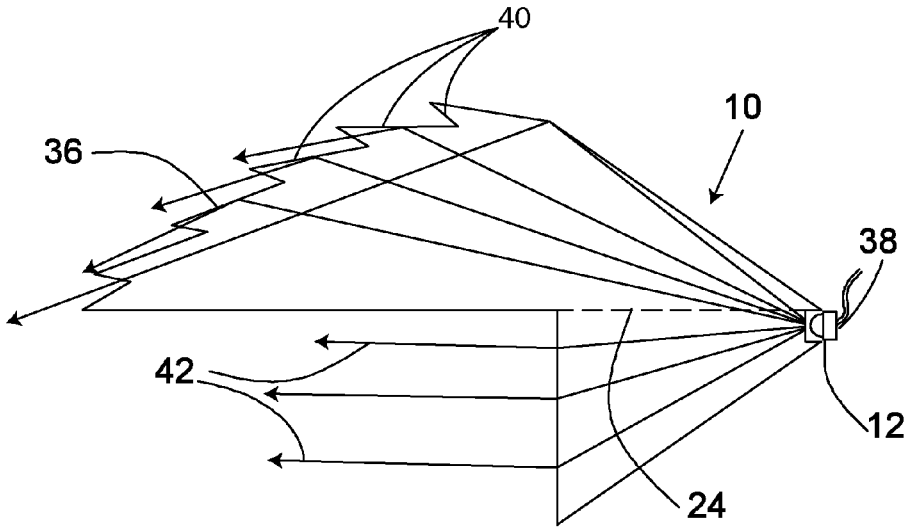
FIG. 5 is a cross sectional view of a version of an extended optic of the disclosed technology.

The light producing assembly can also have a shape which does not have a flat front face. This shape will typically have a front portion and a rear portion, with the rear portion being a conical shape, as described in the previous embodiment, with an LED pocket in which is placed the LED light source and the LED light cover. Light from the LED light source is directed out the conical rear portion of the TIR optic. The front portion of the TIR optic attaches seamlessly to the rear portion, and is only described separately for ease of description, as shown in FIG. 5.

Figure 4:
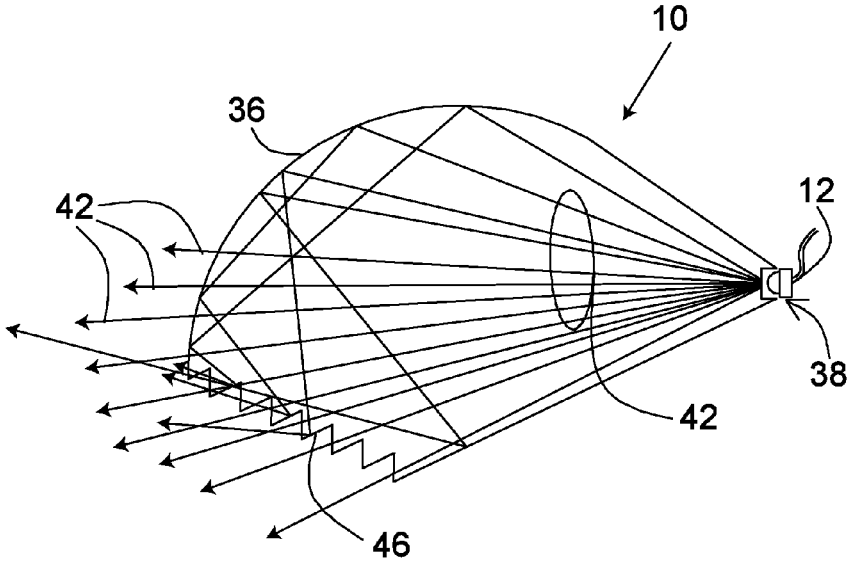
FIG. 4 is a cross sectional view of a version of an extended optic of the disclosed technology.
Figure 6:
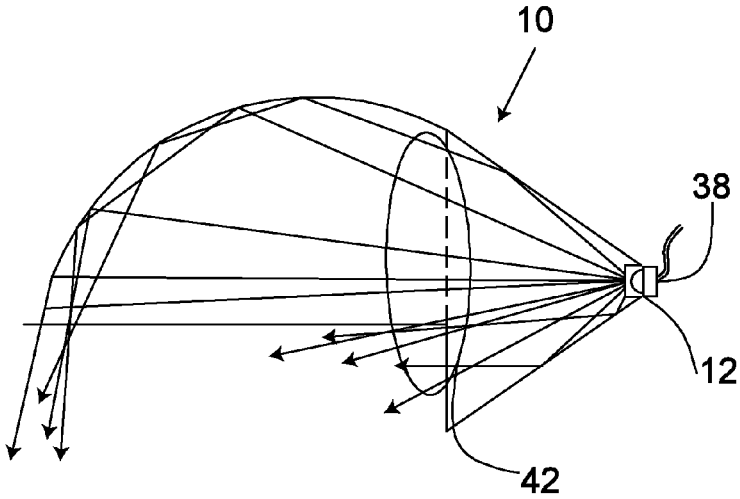
FIG. 6 is a cross sectional view of a version of an extended optic of the disclosed technology.

FIGS. 4 and 6 show versions of the TIR optic 10 with the upper sidewall 36 formed by angled faces, rather than curved. FIG. 5 shows another version of the TIR optic 10, in which the upper sidewall 36 can have a number of angled ledges 40 in the outside surface of the upper sidewall 36, with the ledges 40 provided to change the upward angle of the light, to redirects it straight ahead, rather than up into the sky. As in the previous version, minimal light exits this embodiment above the midplane, as shown in FIG. 5.

The embodiment shown in FIG. 4 has a forward portion upper half 34 with a curving, or rounded, top portion, similar to the quarter oval rounded portion shown in FIG. 6. The curve is defined by the angles needed to reflect light from the LED light source 38 downwards, so that no light escapes from the upper half 22 of the optic. To prevent light from escaping from the upper half of the optic, the curving slope of the rounded top portion is such that the light strikes that surface at an angle less than 42 degrees. At that angle, all of the light is bounced downward and none of it passes out the top half of the optic. The portion of the optic that is directly in front of the light source 38, and below the midplane 24 of the light source, is at an angle to light rays greater than 42 degrees so that light paths 42 from the light source 38 goes directly out the front of the optic 10. This angle could be adjusted to account for refraction to cause the light from the light source to go at the desired angle, which often would be straight ahead. FIG. 7 shows a version in which the upper sidewall 36 of the forward portion 34 includes horizontal reflector 44 which directs the light paths 42 downward, while one or more vertical reflecting surfaces 46 reflects the light to the right or left.

The bottom portion of the optic 10 can have angled ridges 46 as shown in FIG. 4, which are angled so that light striking from the light source passes through the angled ridges, but light striking from the direction of the rounded top portion strikes a surface which bounces the light straight forward. In this way, all of the light from the light source ends up going either straight forward or some light ends up going in a downward direction. Similarly, some of the angles of the optic can be modified to direct beams of light towards the left side or the right side, as shown in FIG. 7 or in any direction for which the particular application the optic is designed.

When designing an extended TIR optic 10 of the disclosed technology, it is sometimes easier to reverse engineer the optic. First, decide where you want the light to go, and then determine the angle of refraction and the angle of recedence for a number of light beams. This will determine the distance of the extension for the optic and the angle for the reflector surface.

The figures include a number of optic shapes which achieve this purpose, that of shaping the light to have all of the light from an LED light source through an optic with the light directed straight forward, and with very little of the light from the LED light source being directed above the midplane of the optic, and thus, not into driver's eyes, into low fog, or snow or rain.

Shown in FIG. 7 is an embodiment which produces an asymmetrical spread of light. As in the other embodiments, the rear half of the optic forms a generally cone shaped structure with an LED pocket 12 in which is housed an LED 38 and an LED cover 18. If the LED were made to fit securely in the base of the optic, the LED cover 18 could be dispensed with. This particular version of the disclosed technology has a flat end 14 on the cone as did the embodiment of FIG. 2. The upper part 22 of the front section 34 includes flat angled surfaces which direct light out to the left and right sides. These are called the vertical reflectors 48. Thus, all of the light which goes into the upper part of the cone gets reflected either to the right or to the left and all of the light which goes into the lower part of the cone is directed straight forward and down. Thus, the upper part of this optic is divided into two halves which extend beyond the face of the lower part of the cone. Each face has a triangular shaped flat inner portion, and a curved sidewall consistent with the other shapes on the front part of the optic. The two flat surfaces basically split the beams of light to the left and right and send them to the left and right of the light source, or downward.

Figure 8:
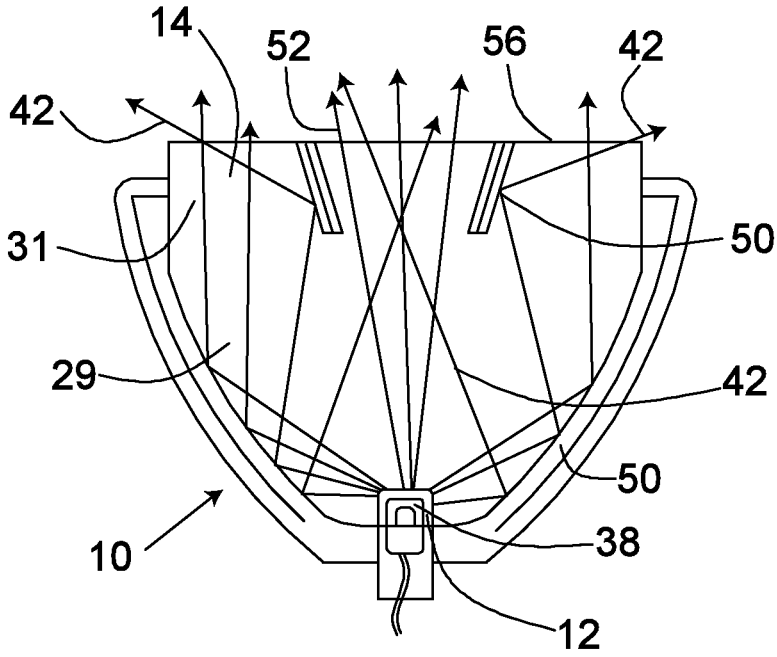
FIG. 8 is a cross sectional side view of a version of an extended optic of the disclosed technology with internal air slots.

Another preferred embodiment of the optic of the disclosed technology is one in which the optic 10 of the invention is generally conical with a flat face 14, as shown in FIG. 8. One or more air spaces 50 are formed in the optic, which extend to the face of the optic. These air spaces 50 form a plastic/air interface, and thus serve as reflecting surfaces, using TIR to reflect beams of light 42 to the side from the air spaces. Since a portion of the flat face is unobstructed by the air spaces, a forward beam of light 52 from the LED light source 38 can go straight out the front of the optic 14. Similarly, air spaces such as shown in the figure can be placed along the forward portion face 56 of the optic to provide any shape of light that is desired, such as to block light exiting from the midplane of the optic to keep light from the optic exiting the optic below the midplane. This version shows the rear portion having a flat face 14 and the forward portion having a flat face 56.

Figure 9:
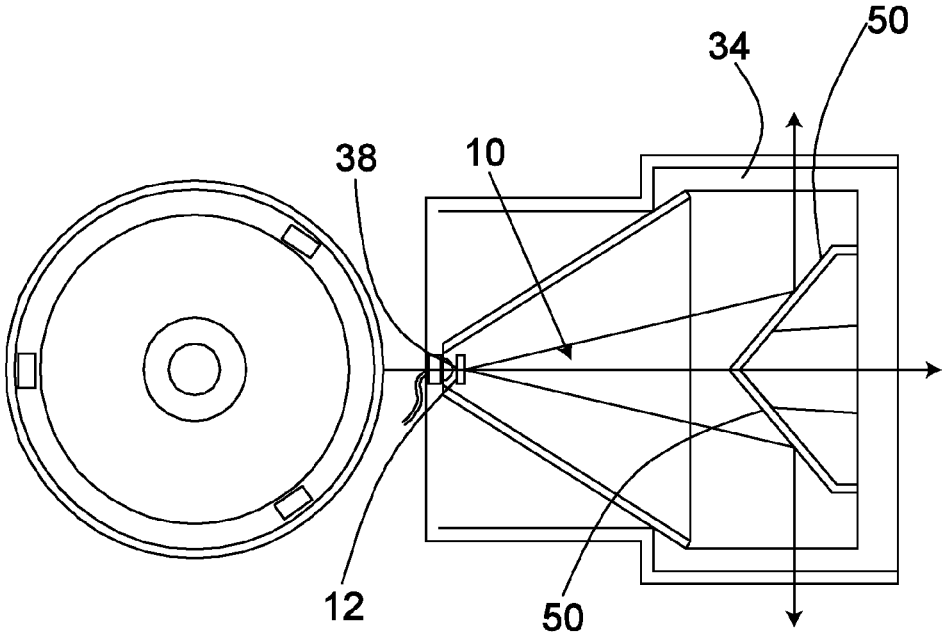
FIG. 9 is a cross sectional side view of a version of an extended optic of the disclosed technology with an internal cone cutout.
Figure 10:
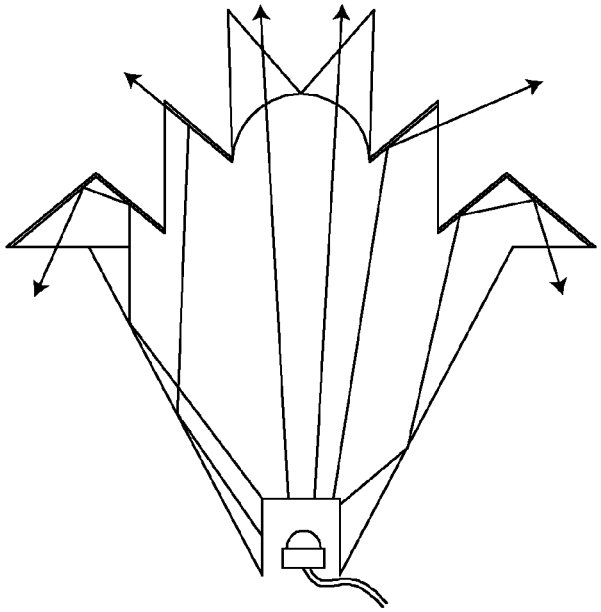
FIG. 10 is a cross sectional view of a version of an extended optic of the disclosed technology.

FIG. 9 shows another version of the optic 10 of the disclosed technology, with air spaces forming surfaces which will reflect light to the sides of the optic 10. FIG. 10 shows another version of the optic 10 of the invention with side reflecting surfaces 48 for directing light to the sides of a beam of light.

While certain exemplary embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A light producing assembly for producing a controlled spread of light, comprising:

an LED light source;

an LED light cover;

a TIR optic of solid transparent material mounted adjacent to said LED light source;

a rear portion of said TIR optic comprising a generally conical cone of solid transparent material, with an apex at a first end, a circumvolving lower sidewall, with an LED pocket defined in said apex of said TIR optic, said rear portion comprising a midplane which passes through said LED pocket, with said LED pocket configured to surround an LED light source;

a forward portion contiguous with said rear portion of said TIR optic comprising one or more light redirecting surfaces for redirecting light paths from said LED light source to limit light from said light assembly to light below said midplane of said TIR optic; wherein a forward portion upper surface angled to direct light via total internal reflectance from said light source so a minimal amount of light exits said forward portion upper surface and a maximal amount of light exits said light assembly below said midplane, for illuminating an area of roadway ahead and to the side, while limiting the light directed above said midplane of said TIR optic.

2. The light producing assembly of claim 1 in which said rear portion ends at a generally flat face at an end opposite said apex and below said midplane, with said forward portion attached to said rear portion and extending away from said apex above said midplane.

3. The light producing assembly of claim 1 in which said forward portion comprises a generally ¼ oval shape in cross section.

4. The light producing assembly of claim 1 in which said forward portion is angled toward said midplane and away from said apex.

5. The light producing assembly of claim 2 in which an upper surface of said forward portion of said TIR optic further comprises a plurality of angled ledges, with said angled ledges configured to reflect light by TIR in a downward or sideways direction from said midplane.

6. The light producing assembly of claim 1 in which said TIR optic is comprised of PMMA acrylic.

7. The light producing assembly of claim 2 in which an upper surface of said forward portion of said TIR optic further comprises a plurality of sloped facets, with said sloped facets configured to reflect light by TIR in a downward or sideways direction from said midplane.

8. The light assembly for producing a controlled spread of light of claim 1 in which said rear portion ends at a generally flat face at an end opposite said apex, with said forward portion attached to said flat face of said rear portion and extending away from said apex to a front portion flat face, with said forward portion comprising one or more slot-like air spaces, with said air space walls comprising reflective surfaces for directing light via TIR from said LED light source to the sides of said light assembly.

9. A light producing assembly for producing a controlled spread of light, comprising:

an LED light source;

an LED light cover;

a TIR optic of solid transparent material mounted adjacent to said LED light source;

a rear portion of said TIR optic comprising a generally conical cone of solid transparent material, with an apex at a first end, a circumvolving lower sidewall, with an LED pocket defined in said apex of said TIR optic, said rear portion comprising a midplane which passes through said LED pocket, with said LED pocket configured to surround an LED light source, with said rear portion ending at a generally flat face at an end opposite said apex and below said midplane;

a forward portion contiguous with said rear portion of said TIR optic comprising one or more light redirecting surfaces for redirecting light paths from said LED light source to limit light from said light assembly to light below said midplane of said TIR optic, with said forward portion attached to said rear portion and extending away from said apex above said midplane; wherein a forward portion upper surface angled to direct light via total internal reflectance from said light source so a minimal amount of light exits said forward portion upper surface and a maximal amount of light exits said light assembly below said midplane, for illuminating an area of roadway ahead and to the side, while limiting the light directed above said midplane of said TIR optic.

10. A light producing assembly for asymmetrical light beam production comprising:

an LED light source;

an LED light cover;

a TIR optic of solid transparent material mounted adjacent to said LED light source;

a rear portion of said TIR optic comprising a cone of solid transparent material, with an apex, a circumvolving sidewall and a generally cylindrical LED pocket defined in said apex of said upper and lower halves of said TIR optic conical first portion, with said LED pocket configured to surround and cover said LED light cover;

a front portion of said TIR optic comprising in side view a rounded top portion, a sloping face portion, a front bottom portion comprised of a number of reflective angled ridges for directing light from above to a forward trajectory, and a sloping rear portion joining the lower part of said rear conical portion, said TIR option made of solid transparent material, with said front portion seamlessly contiguous with said rear portion; wherein said rounded top portion is curved to direct light downward via total internal reflectance from said light source so a minimal amount of light exits said rounded top portion, with light reflected from said rounded top portion striking said front bottom portion and being reflected by TIR in a forward direction, for illuminating an area of roadway ahead and to the side, while limiting the light directed above a midplane of said TIR optic.

11. The light producing assembly of claim 10 in which said TIR optic is comprised of PMMA acrylic material.

12. The light producing assembly of claim 10, in which said sloping face portion is at an angle of greater than approximately 42 degrees to light beams directly from said light source, so that light beams directly from the light source pass through the sloping face portion.

13. The light producing assembly of claim 10, in which said sloping rear portion is at an angle of less than approximately 42 degrees to light beams directly from said light source, so that light beams directly from the light source do not pass through the sloping rear portion, but are reflected by TIR to a forward direction.

* * * * *